US008545371B2

(12) United States Patent
Wang

(10) Patent No.: US 8,545,371 B2
(45) Date of Patent: Oct. 1, 2013

(54) REHABILITATION EXERCISING EQUIPMENT THAT CAN EXTEND A USER'S ARMS

(75) Inventor: Shih-Jung Wang, Taiping (TW)

(73) Assignee: Preventive Medical Health Care Co., Ltd., Taoyuan County (TW)

( * ) Notice: Subject to any disclaimer, the term of this patent is extended or adjusted under 35 U.S.C. 154(b) by 223 days.

(21) Appl. No.: 13/166,888

(22) Filed: Jun. 23, 2011

(65) Prior Publication Data

US 2012/0329607 A1 Dec. 27, 2012

(51) Int. Cl.
*A63B 22/00* (2006.01)

(52) U.S. Cl.
USPC ..... 482/51

(58) Field of Classification Search
USPC ..... 482/51–52, 57, 62–63, 92, 133–138, 482/148; 601/23, 33–36
See application file for complete search history.

(56) References Cited

U.S. PATENT DOCUMENTS 3,213,852 A * 10/1965 Zent ..... 601/36
5,310,392 A * 5/1994 Lo ..... 482/63
7,530,932 B2 * 5/2009 Lofgren et al. ..... 482/62

* cited by examiner

*Primary Examiner* — Loan Thanh
*Assistant Examiner* — Jennifer M Deichl
(74) *Attorney, Agent, or Firm* — Alan Kamrath; Kamrath IP Lawfirm, P.A.

(57) ABSTRACT

A rehabilitation exercising equipment includes a main frame, a first geared member rotatably mounted on the main frame, a second geared member rotatably mounted on the main frame, two handlebars secured on the first geared member and the second geared member respectively, a connecting mechanism mounted between the first geared member and the second geared member to connect the first geared member and the second geared member, and a transmission mechanism mounted between the main frame and the second geared member. Thus, a user's two hands can hold the handlebars to pivot the handlebars in two opposite directions by connection of the connecting mechanism so as to achieve an exercising or rehabilitating function.

12 Claims, 12 Drawing Sheets

REHABILITATION EXERCISING EQUIPMENT THAT CAN EXTEND A USER'S ARMS

BACKGROUND OF THE INVENTION

1. Field of the Invention

The present invention relates to a rehabilitation equipment and, more particularly, to a rehabilitation exercising equipment.

2. Description of the Related Art

A conventional rehabilitation equipment comprises a support frame, a pedal portion mounted on the support frame, and a handle portion mounted on the support frame and connected with the pedal portion to move in concert with the pedal portion. Thus, when a user holds the handle portion and treads the pedal portion, the handle portion is driven by the pedal portion to move upward and downward so as to provide a rehabilitating function to the user's two hands. However, when the user's legs are injured, he/she cannot tread the pedal portion to drive the handle portion easily, thereby causing inconvenience to the user, and thereby decreasing the rehabilitating effect of the rehabilitation equipment.

BRIEF SUMMARY OF THE INVENTION

In accordance with the present invention, there is provided a rehabilitation exercising equipment, comprising a main frame, a first geared member rotatably mounted on the main frame, a second geared member rotatably mounted on the main frame, two handlebars secured on the first geared member and the second geared member to rotate in concert with the first geared member and the second geared member respectively, and a transmission mechanism mounted between the main frame and the second geared member.

The transmission mechanism includes a first driven geared member secured on the second geared member to rotate in concert with the second geared member, a support shaft rotatably mounted on the main frame, a second driven geared member secured on and driven by the support shaft, a first linking member mounted between the first driven geared member and the second driven geared member to link the first driven geared member and the second driven geared member, a drive geared member secured on the support shaft to drive the support shaft, a drive unit mounted on the main frame, a driving geared member rotatably mounted on the drive unit, and a second linking member mounted between the driving geared member and the drive geared member to link the driving geared member and the drive geared member.

The rehabilitation exercising equipment further comprises a connecting mechanism mounted between the first geared member and the second geared member to connect the first geared member and the second geared member so that the first geared member and the second geared member are movable in concert with each other.

The primary objective of the present invention is to provide a rehabilitation exercising equipment that can extend a user's arms.

According to the primary advantage of the present invention, a user's two hands can hold the two handlebars to pivot the two handlebars in two opposite directions by connection of the connecting mechanism so as to achieve an exercising or rehabilitating function.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
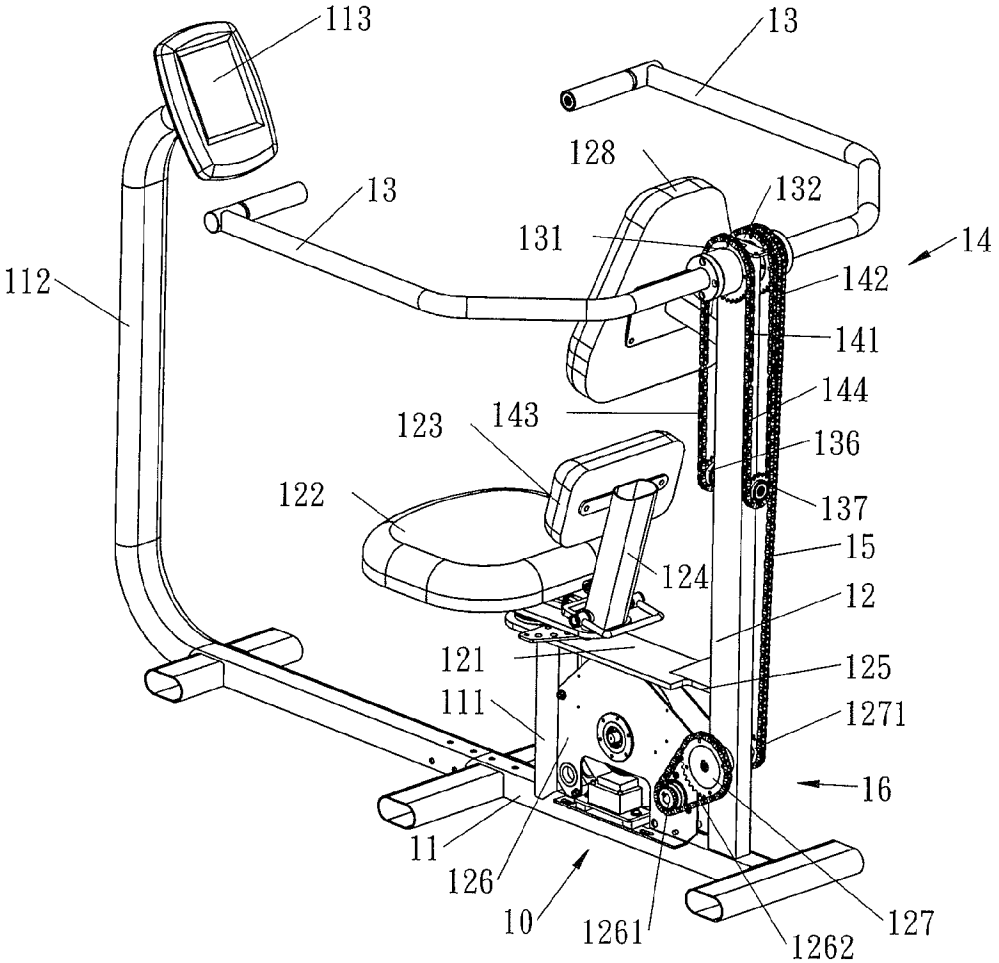
FIG. 1 is a perspective view of a rehabilitation exercising equipment in accordance with the preferred embodiment of the present invention.

Referring to the drawings and initially to FIGS. 1-6, a rehabilitation exercising equipment in accordance with the preferred embodiment of the present invention comprises a main frame 10, a first geared member 131 rotatably mounted on the main frame 10, a second geared member 132 rotatably mounted on the main frame 10, a connecting mechanism 14 mounted between the first geared member 131 and the second geared member 132 to connect the first geared member 131 and the second geared member 132 so that the first geared member 131 and the second geared member 132 are movable in concert with each other, a first idle geared member 136 rotatably mounted on the main frame 10 and connected with the connecting mechanism 14, a second idle geared member 137 rotatably mounted on the main frame 10 and connected with the connecting mechanism 14, and two handlebars 13 secured on the first geared member 131 and the second geared member 132 to rotate in concert with the first geared member 131 and the second geared member 132 respectively.

The main frame 10 includes a transverse bar 11, an upright post 12 mounted on the transverse bar 11, a support post 111 mounted on the transverse bar 11, a support plate 121 mounted between the upright post 12 and the support post 111, a seat 122 mounted on the support plate 121, a back support 124 mounted on the support plate 121, a seat back 123 mounted on the back support 124 and located above the seat 122, a back cushion 128 mounted on the upright post 12 and located above the seat back 123, an extension bar 112 connected with the transverse bar 11, and a control panel 113 mounted on the extension bar 112. The control panel 113 of the main frame 10 is preferably an electronic instrument panel. The main frame 10 further includes a receiving space 125 defined between the transverse bar 11, the upright post 12, the support post 111 and the support plate 121.

The first geared member 131 and the second geared member 132 are rotatably mounted on the upright post 12 of the main frame 10. The first geared member 131 and the second geared member 132 are parallel with each other. Each of the two handlebars 13 is pivotally mounted on the main frame 10 and pivoted about the upright post 12 of the main frame 10 in a curved manner. The two handlebars 13 are pivoted in two opposite directions by connection of the connecting mechanism 14.

The first idle geared member 136 and the second idle geared member 137 are rotatably mounted on the upright post 12 of the main frame 10 and are located under the first geared member 131 and the second geared member 132. The first idle geared member 136 and the second idle geared member 137 are parallel with each other. The first idle geared member 136 and the second idle geared member 137 are perpendicular to the first geared member 131 and the second geared member 132.

The connecting mechanism 14 is connected between the first geared member 131, the second geared member 132, the first idle geared member 136 and the second idle geared member 137. The connecting mechanism 14 includes a first connecting portion 141 meshing with the first geared member 131, a second connecting portion 142 meshing with the second geared member 132, a third connecting portion 143 meshing with the first idle geared member 136 and a fourth connecting portion 144 meshing with the second idle geared member 137.

The first connecting portion 141 and the second connecting portion 142 of the connecting mechanism 14 are parallel with each other. Each of the first connecting portion 141 and the second connecting portion 142 of the connecting mechanism 14 has a substantially inverted U-shaped profile and has a first distal end connected with the third connecting portion 143 and a second distal end connected with the fourth connecting portion 144.

The third connecting portion 143 and the fourth connecting portion 144 of the connecting mechanism 14 are parallel with each other. Each of the third connecting portion 143 and the fourth connecting portion 144 of the connecting mechanism 14 traverses and connects the first connecting portion 141 and the second connecting portion 142 so that the third connecting portion 143 and the fourth connecting portion 144 of the connecting mechanism 14 are perpendicular to the first connecting portion 141 and the second connecting portion 142. Each of the third connecting portion 143 and the fourth connecting portion 144 of the connecting mechanism 14 has a substantially U-shaped profile and has a first distal end connected with the first connecting portion 141 and a second distal end connected with the second connecting portion 142.

The rehabilitation exercising equipment further comprises a transmission mechanism 16 mounted between the main frame 10 and the second geared member 132. The transmission mechanism 16 includes a first driven geared member 133 secured on the second geared member 132 to rotate in concert with the second geared member 132, a support shaft 1270 rotatably mounted on the main frame 10, a second driven geared member 1271 secured on and driven by the support shaft 1270, a first linking member 15 mounted between the first driven geared member 133 and the second driven geared member 1271 to link the first driven geared member 133 and the second driven geared member 1271, a drive geared member 127 secured on the support shaft 1270 to drive the support shaft 1270, a drive unit 126 mounted on the main frame 10, a driving geared member 1261 rotatably mounted on the drive unit 126, and a second linking member 1262 mounted between the driving geared member 1261 and the drive geared member 127 to link the driving geared member 1261 and the drive geared member 127. The support shaft 1270 of the transmission mechanism 16 is rotatably mounted on the upright post 12 of the main frame 10. The drive unit 126 of the transmission mechanism 16 is received in the receiving space 125 of the main frame 10. The drive unit 126 of the transmission mechanism 16 is electrically connected to and controlled by the control panel 113 of the main frame 10 so that the control panel 113 of the main frame 10 can control operation of the drive unit 126.

In the preferred embodiment of the present invention, the drive unit 126 of the transmission mechanism 16 is a magnetically controlled resistance device. Alternatively, the drive unit 126 of the transmission mechanism 16 is a powered motor. In addition, each of the connecting mechanism 14, the first linking member 15 and the second linking member 1262 is a toothed belt. Alternatively, each of the first geared member 131, the second geared member 132, the first idle geared member 136, the second idle geared member 137, the first driven geared member 133, the second driven geared member 1271, the driving geared member 1261 and the drive geared member 127 is a sprocket, while each of the connecting mechanism 14, the first linking member 15 and the second linking member 1262 is a chain.

Figure 2:
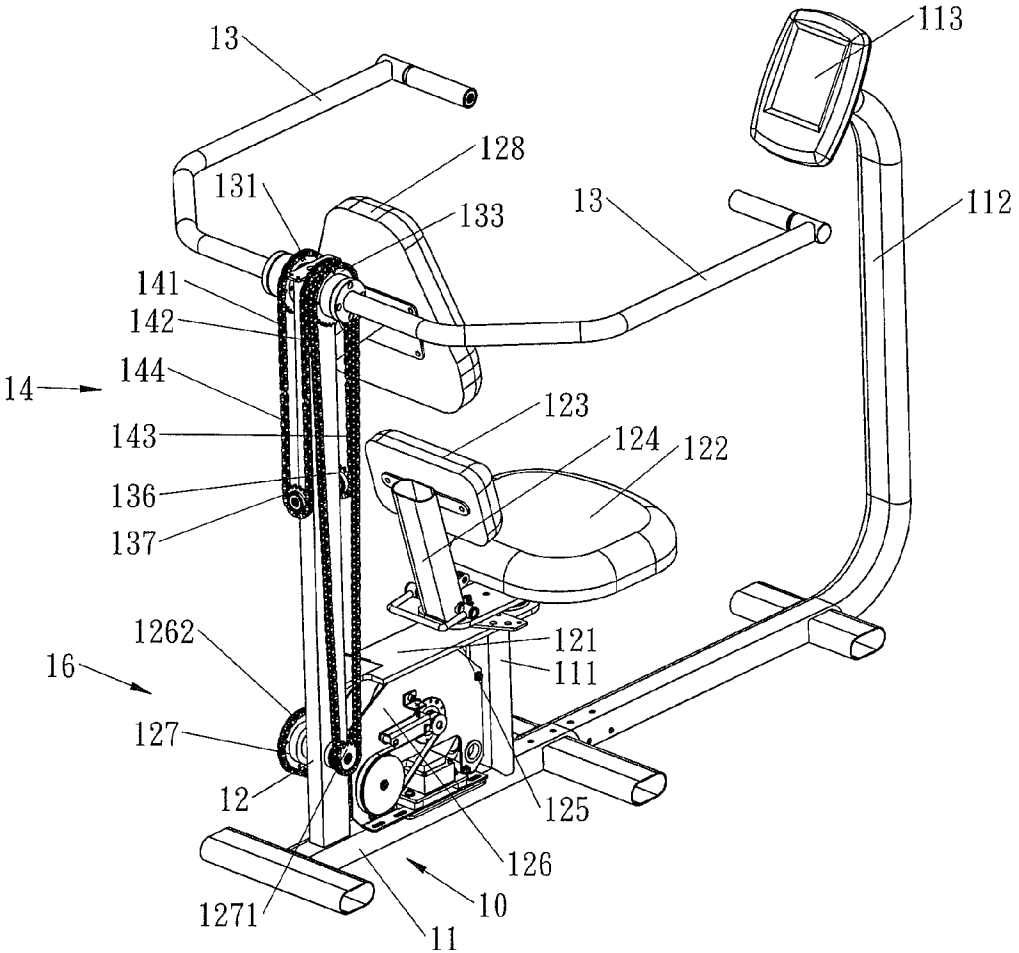
FIG. 2 is another perspective view of the rehabilitation exercising equipment as shown in FIG. 1.
Figure 3:
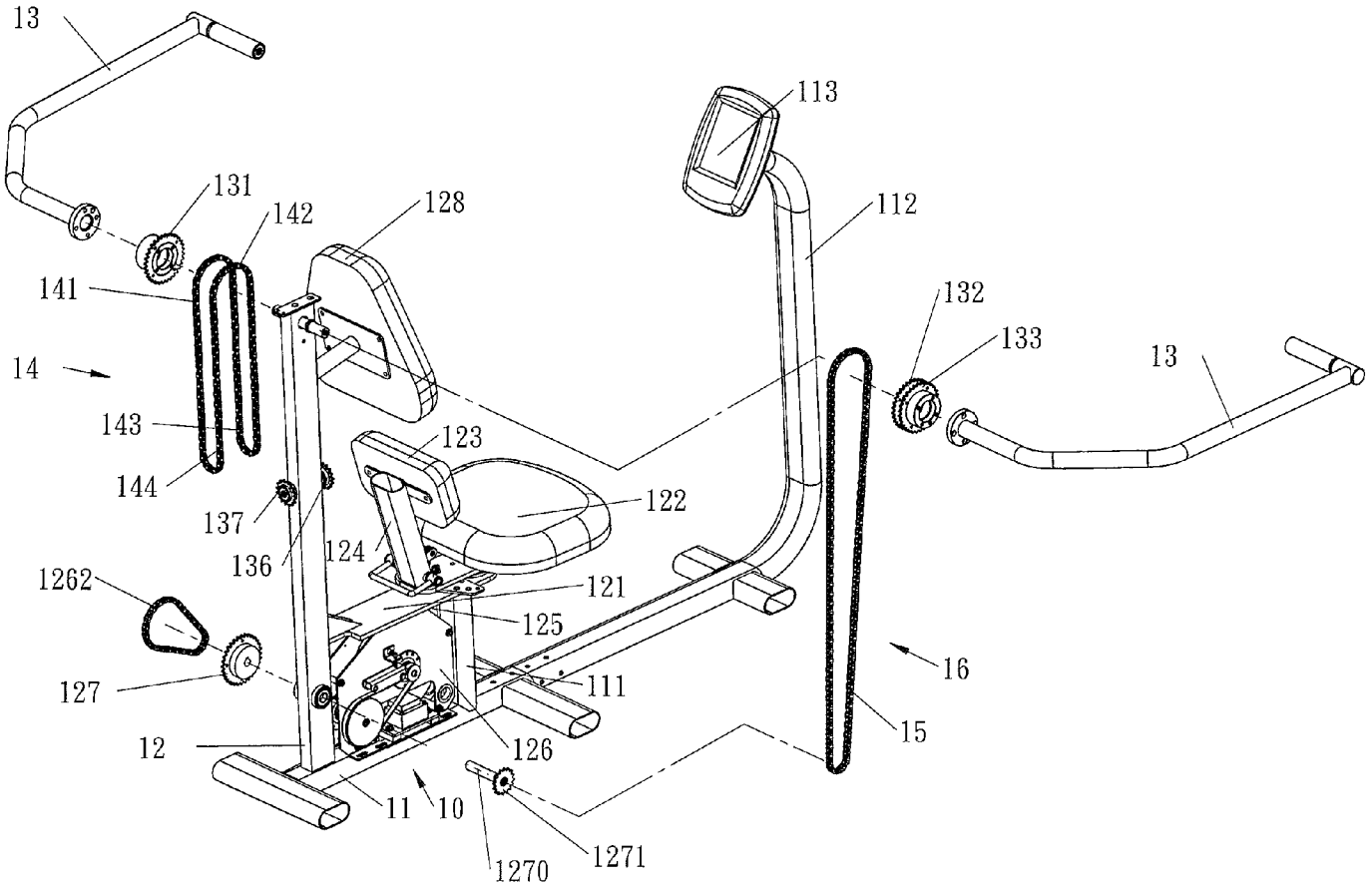
FIG. 3 is an exploded perspective view of the rehabilitation exercising equipment as shown in FIG. 1.
Figure 4:
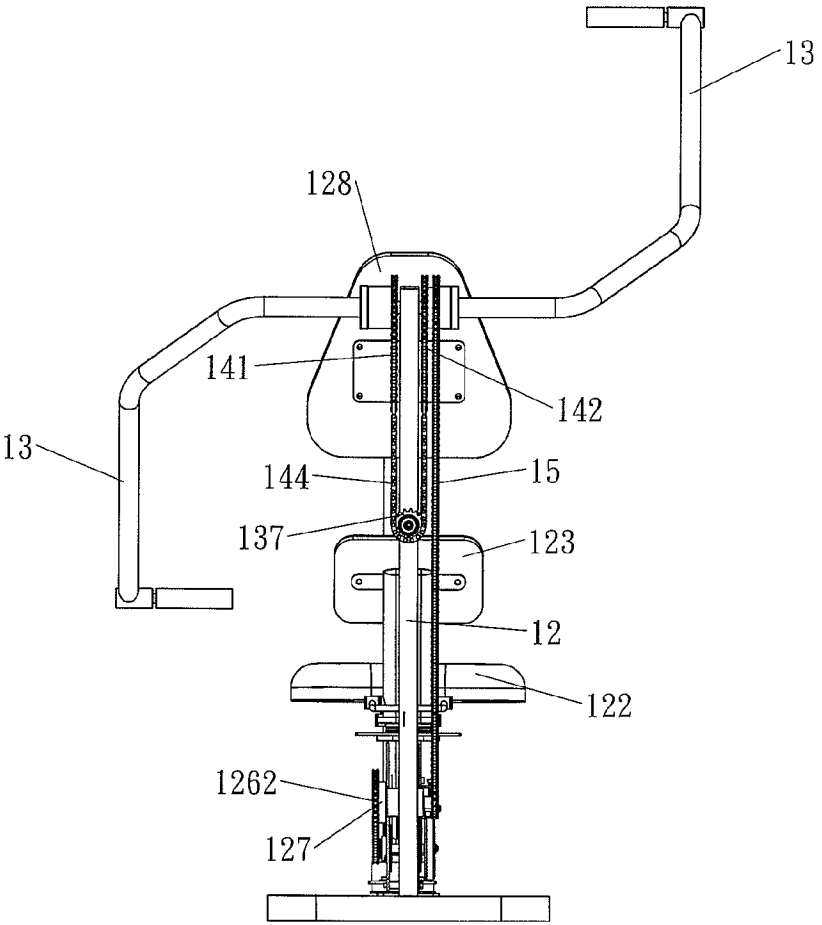
FIG. 4 is a side operational view of the rehabilitation exercising equipment as shown in FIG. 1.
Figure 5:
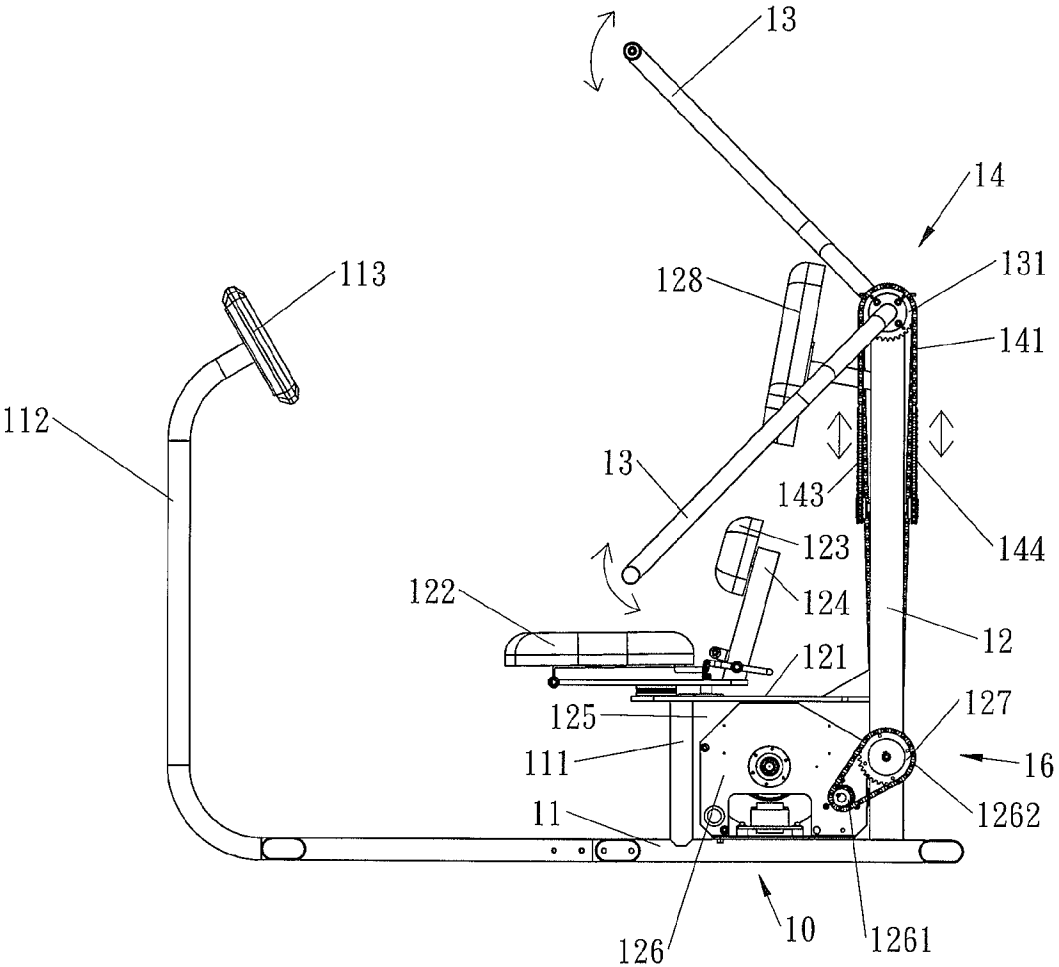
FIG. 5 is a front operational view of the rehabilitation exercising equipment as shown in FIG. 1.
Figure 6:
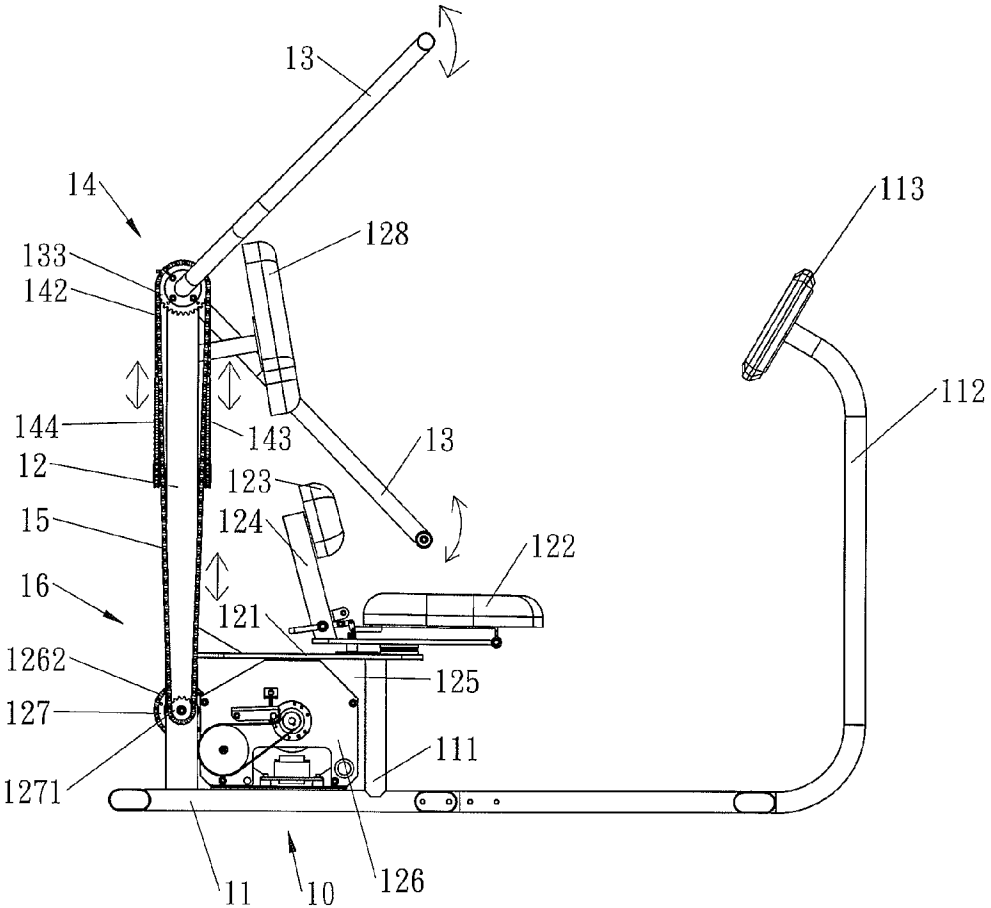
FIG. 6 is a front operational view of the rehabilitation exercising equipment as shown in FIG. 2.

In operation, referring to FIGS. 4-6 with reference to FIGS. 1-3, the connecting mechanism 14 is mounted between the first geared member 131, the second geared member 132, the first idle geared member 136 and the second idle geared member 137 so that the first geared member 131 and the second geared member 132 are moved in concert with each other and are moved in two opposite directions. In such a manner, the two handlebars 13 are pivoted about the upright post 12 of the main frame 10 in two opposite directions. Thus, a user's two hands can hold the two handlebars 13 to pivot the two handlebars 13 in two opposite directions by connection of the connecting mechanism 14 so as to achieve an exercising or rehabilitating function.

In the preferred embodiment of the present invention, when the drive unit 126 of the transmission mechanism 16 is a magnetically controlled resistance device, the drive unit 126 provides a damping force to the first driven geared member 133 by connection of the second linking member 1262 and the first linking member 15 to damp rotation of the first geared member 131 and the second geared member 132 and to damp pivot action of the two handlebars 13 so as to provide a resistance to the user's two hands, thereby enhancing the exercising or rehabilitating effect.

Alternatively, when the drive unit 126 of the transmission mechanism 16 is a powered motor, the drive unit 126 drives the driving geared member 1261 which drives the second linking member 1262 which drives the drive geared member 127 which drives the support shaft 1270 which drives the second driven geared member 1271 which drives the first linking member 15 which drives the first driven geared member 133 which drives the second geared member 132 which drives the connecting mechanism 14 which drives the first geared member 131 so that the two handlebars 13 are moved by the first geared member 131 and the second geared member 132 and are pivoted in two opposite directions by connection of the connecting mechanism 14 to move the user's two hands so as to achieve a rehabilitating function.

Accordingly, a user's two hands can hold the two handlebars 13 to pivot the two handlebars 13 in two opposite directions by connection of the connecting mechanism 14 so as to achieve an exercising or rehabilitating function. In addition, the drive unit 126 of the transmission mechanism 16 functions as a magnetically controlled resistance device to provide a damping force to the first driven geared member 133 by connection of the second linking member 1262 and the first linking member 15 to damp rotation of the first geared member 131 and the second geared member 132 and to damp pivot action of the two handlebars 13 so as to provide a resistance to the user's two hands, thereby enhancing the exercising or rehabilitating effect. Further, the drive unit 126 of the transmission mechanism 16 functions as a powered motor to drive the first driven geared member 133 by connection of the second linking member 1262 and the first linking member 15 and to drive the second geared member 132 and the first geared member 131 by connection of the connecting mechanism 14 so that the two handlebars 13 are moved by the first geared member 131 and the second geared member 132 and are pivoted in two opposite directions by connection of the connecting mechanism 14 to move the user's two hands so as to achieve a rehabilitating function.

Figure 7:
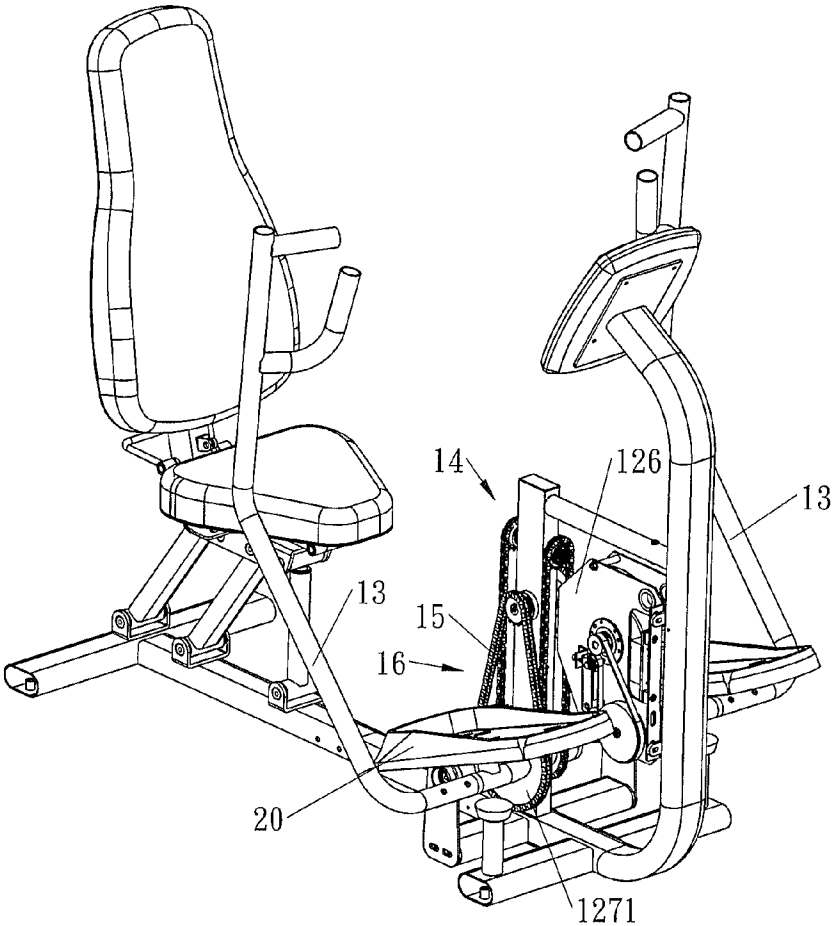
FIG. 7 is a perspective view of a rehabilitation exercising equipment in accordance with another preferred embodiment of the present invention.
Figure 8:
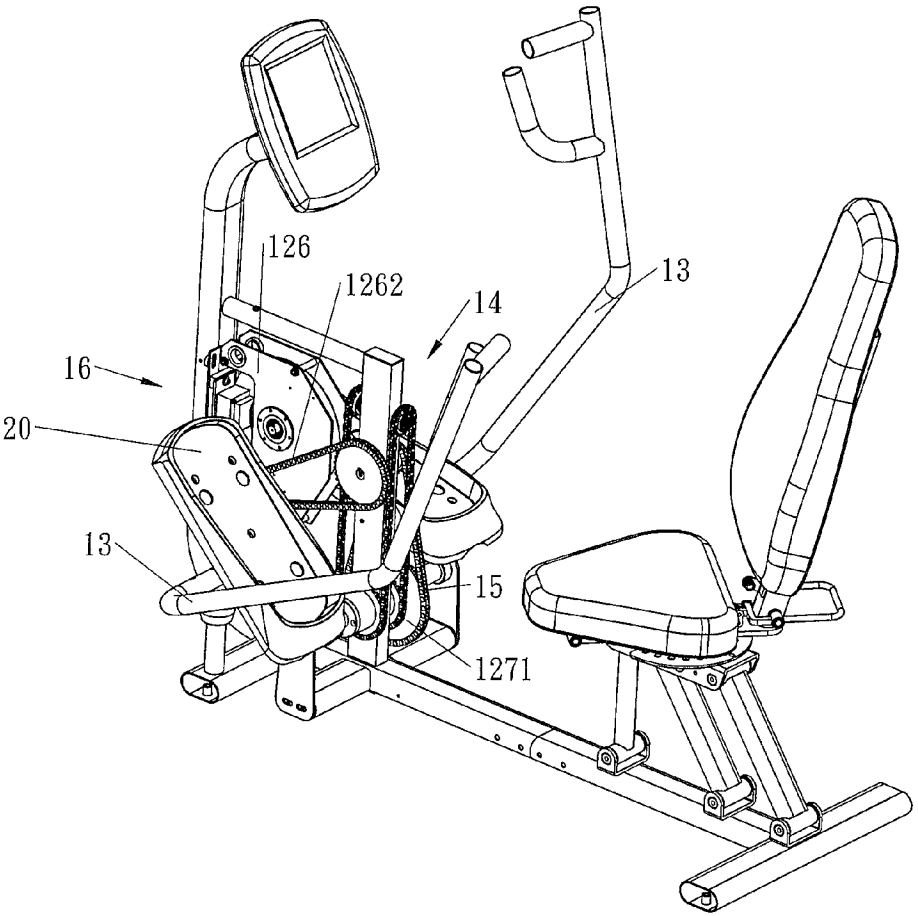
FIG. 8 is another perspective view of the rehabilitation exercising equipment as shown in FIG. 7.

Referring to FIGS. 7 and 8, the rehabilitation exercising equipment further comprises two pedals 20 mounted on the two handlebars 13 respectively.

Figure 9:
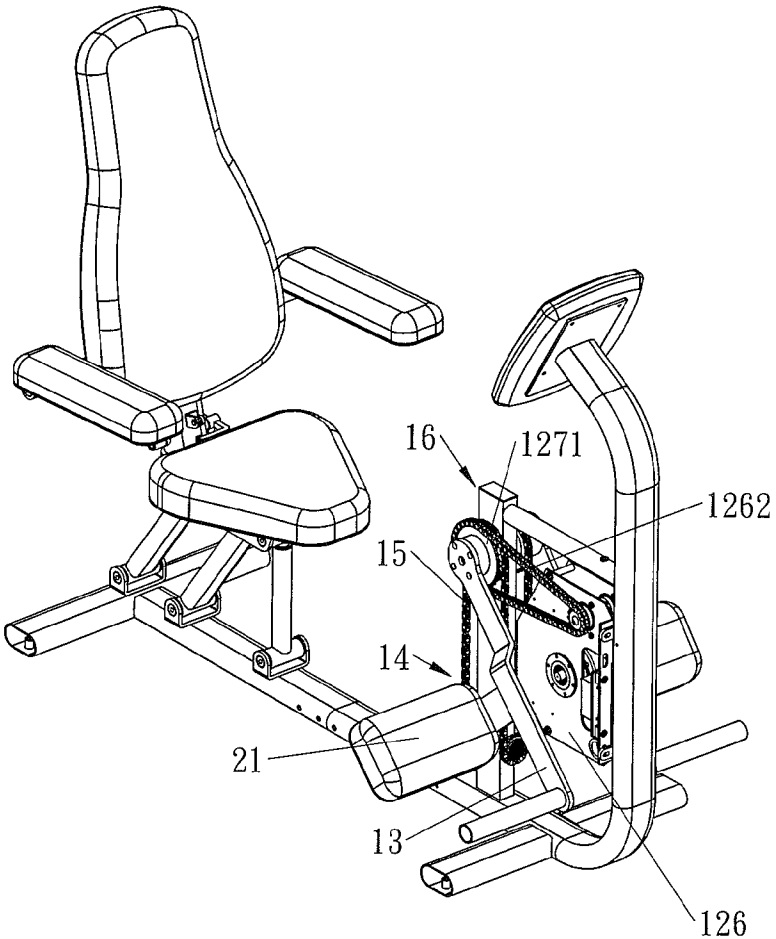
FIG. 9 is a perspective view of a rehabilitation exercising equipment in accordance with another preferred embodiment of the present invention.
Figure 10:
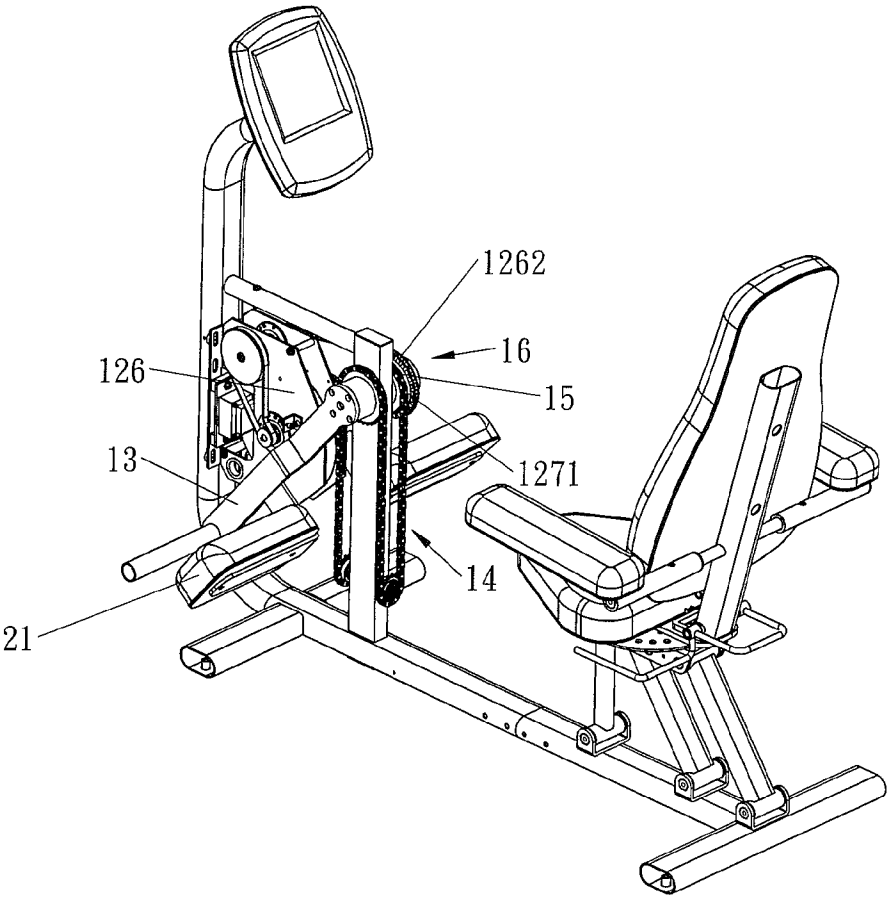
FIG. 10 is another perspective view of the rehabilitation exercising equipment as shown in FIG. 9.

Referring to FIGS. 9 and 10, the rehabilitation exercising equipment further comprises two pedals 21 mounted on the two handlebars 13 respectively.

Figure 11:
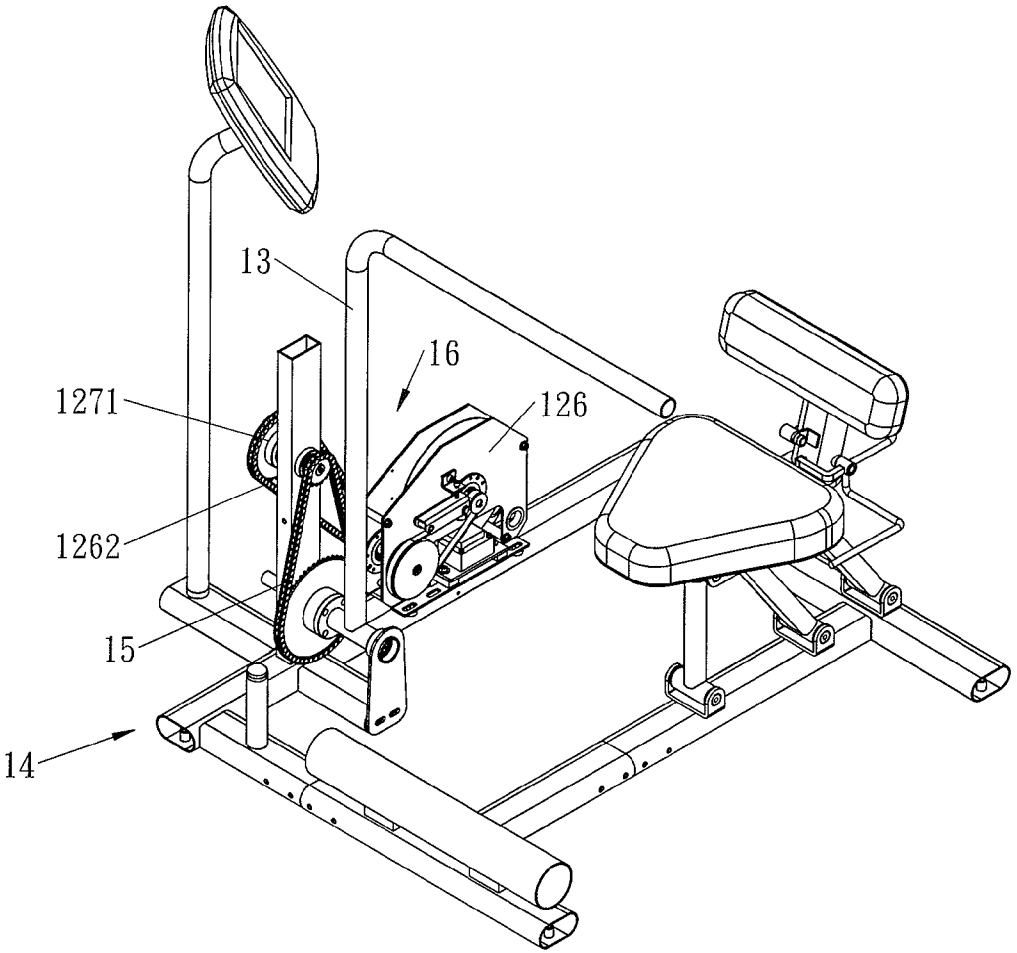
FIG. 11 is a perspective view of a rehabilitation exercising equipment in accordance with another preferred embodiment of the present invention.
Figure 12:
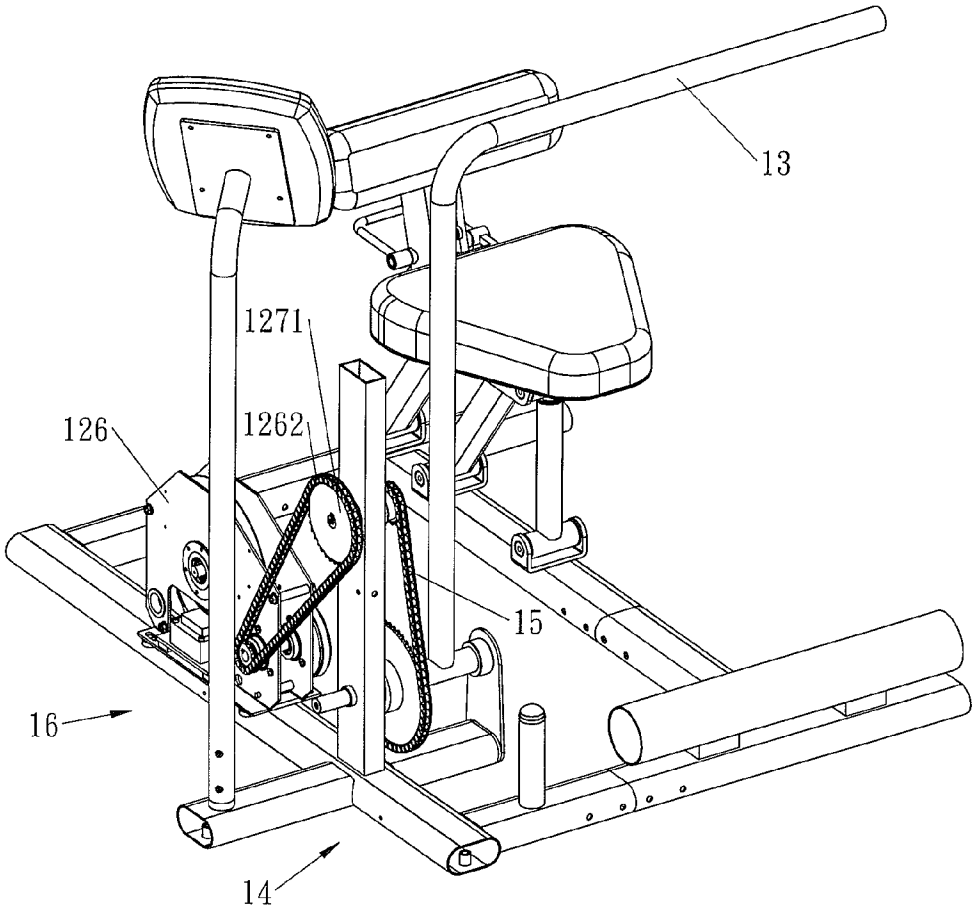
FIG. 12 is another perspective view of the rehabilitation exercising equipment as shown in FIG. 11.

Referring to FIGS. 11 and 12, only one handlebar 13 is defined.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. Rehabilitation exercising equipment comprising:

a main frame including a transverse bar and an upright post mounted on the transverse bar;

a first geared member rotatably mounted on the main frame;

a second geared member rotatably mounted on the main frame, wherein the first geared member and the second geared member are rotatably mounted on the upright post of the main frame;

two handlebars secured on the first geared member and the second geared member to rotate in concert with the first geared member and the second geared member respectively;

a transmission mechanism mounted between the main frame and the second geared member;

wherein the transmission mechanism includes:

a first driven geared member secured on the second geared member to rotate in concert with the second geared member;

a support shaft rotatably mounted on the main frame;

a second driven geared member secured on and driven by the support shaft;

a first linking member mounted between the first driven geared member and the second driven geared member to link the first driven geared member and the second driven geared member;

a drive geared member secured on the support shaft to drive the support shaft;

a drive unit mounted on the main frame;

a driving geared member rotatably mounted on the drive unit; and a second linking member mounted between the driving geared member and the drive geared member to link the driving geared member and the drive geared member, wherein the support shaft of the transmission mechanism is rotatably mounted on the upright post of the main frame;

a connecting mechanism mounted between the first geared member and the second geared member to connect the first geared member and the second geared member so that the first geared member and the second geared member are movable in concert with each other;

a first idle geared member rotatably mounted on the main frame and connected with the connecting mechanism; and a second idle geared member rotatably mounted on the main frame and connected with the connecting mechanism;

wherein the connecting mechanism is connected between the first geared member, the second geared member, the first idle geared member and the second idle geared member;

wherein the connecting mechanism includes:

a first connecting portion meshing with the first geared member;

a second connecting portion meshing with the second geared member;

a third connecting portion meshing with the first idle geared member; and a fourth connecting portion meshing with the second idle geared member;

wherein the first geared member and the second geared member are parallel with each other;

wherein the first idle geared member and the second idle geared member are parallel with each other;

wherein the first idle geared member and the second idle geared member are perpendicular to the first geared member and the second geared member;

wherein the first connecting portion and the second connecting portion of the connecting mechanism are parallel with each other;

wherein the third connecting portion and the fourth connecting portion of the connecting mechanism are parallel with each other;

wherein each of the third connecting portion and the fourth connecting portion of the connecting mechanism traverses and connects the first connecting portion and the second connecting portion; and wherein the third connecting portion and the fourth connecting portion of the connecting mechanism are perpendicular to the first connecting portion and the second connecting portion.

2. The rehabilitation exercising equipment of claim 1, wherein the main frame further includes:

a support post mounted on the transverse bar; and a support plate mounted between the upright post and the support post; and a receiving space defined between the transverse bar, the upright post, the support post and the support plate; and wherein the drive unit of the transmission mechanism is received in the receiving space of the main frame.

3. The rehabilitation exercising equipment of claim 2, wherein the main frame further includes:

a seat mounted on the support plate;

a back support mounted on the support plate;

a seat back mounted on the back support and located above the seat; and a back cushion mounted on the upright post and located above the seat back.

4. The rehabilitation exercising equipment of claim 1, wherein the main frame further includes:

an extension bar connected with the transverse bar; and a control panel mounted on the extension bar; and wherein the drive unit of the transmission mechanism is electrically connected to and controlled by the control panel of the main frame.

5. The rehabilitation exercising equipment of claim 1, wherein the drive unit of the transmission mechanism is a magnetically controlled resistance device.

6. The rehabilitation exercising equipment of claim 1, wherein the drive unit of the transmission mechanism is a powered motor.

7. The rehabilitation exercising equipment of claim 1, wherein:

each of the first connecting portion and the second connecting portion of the connecting mechanism has a first distal end connected with the third connecting portion and a second distal end connected with the fourth connecting portion; and each of the third connecting portion and the fourth connecting portion of the connecting mechanism has a first distal end connected with the first connecting portion and a second distal end connected with the second connecting portion.

8. The rehabilitation exercising equipment of claim 7, wherein:

each of the first connecting portion and the second connecting portion of the connecting mechanism has a substantially inverted U-shaped profile; and each of the third connecting portion and the fourth connecting portion of the connecting mechanism has a substantially U-shaped profile.

9. The rehabilitation exercising equipment of claim 1, wherein:

the two handlebars are pivoted in two opposite directions by connection of the connecting mechanism; and each of the two handlebars is pivotally mounted on the main frame.

10. The rehabilitation exercising equipment of claim 1, wherein the first idle geared member and the second idle geared member are rotatably mounted on the upright post of the main frame and are located under the first geared member and the second geared member.

11. The rehabilitation exercising equipment of claim 1, wherein each of the connecting mechanism, the first linking member and the second linking member is a toothed belt.

12. The rehabilitation exercising equipment of claim 1, wherein:

each of the first geared member, the second geared member, the first idle geared member, the second idle geared member, the first driven geared member, the second driven geared member, the driving geared member and the drive geared member is a sprocket; and each of the connecting mechanism, the first linking member and the second linking member is a chain.

* * * * *